US009988774B2

(12) United States Patent
Howe et al.

(10) Patent No.: US 9,988,774 B2
(45) Date of Patent: Jun. 5, 2018

(54) ATTACHMENT FOR CLEARANCE OF WORKSITES

(71) Applicant: IronWolf Manufacturing, LLC, Noble, OK (US)

(72) Inventors: Todd Howe, Norman, OK (US); Edward C. Hubkey, Harrah, OK (US)

(73) Assignee: Ironwolf Manufacturing, LLC, Noble, OK (US)

( * ) Notice: Subject to any disclaimer, the term of this patent is extended or adjusted under 35 U.S.C. 154(b) by 0 days. days.

(21) Appl. No.: 14/667,814

(22) Filed: Mar. 25, 2015

(65) Prior Publication Data

US 2015/0275444 A1 Oct. 1, 2015

Related U.S. Application Data

(60) Provisional application No. 61/971,871, filed on Mar. 28, 2014.

(51) Int. Cl.
*E01C 23/088* (2006.01)
*E01C 23/12* (2006.01)

(52) U.S. Cl.
CPC ..... *E01C 23/12* (2013.01); *E01C 23/088* (2013.01); *E01C 23/127* (2013.01); *E01C 2301/50* (2013.01)

(58) Field of Classification Search
CPC ..... E01C 23/088; E01C 23/127; A01B 63/00; A01B 63/104; A01B 63/11; A01B 63/1145; A01B 63/008; A01B 63/111; A01B 63/114
USPC ..... 172/452, 474, 668
See application file for complete search history.

(56) References Cited

U.S. PATENT DOCUMENTS

| | | | | |
|---|---|---|---|---|
| 3,271,939 | A | 9/1966 | Granger, Jr. et al. | |
| 3,754,603 | A | 8/1973 | Bogie | |
| 4,041,996 | A | 8/1977 | Grover | |
| 4,103,973 | A * | 8/1978 | Cutler | E01C 23/127 299/39.6 |
| 4,896,995 | A * | 1/1990 | Simmons | E01C 23/088 299/39.1 |
| 4,889,522 | A | 2/1990 | Munger | |
| 5,003,759 | A | 4/1991 | Brown | |
| 5,666,794 | A | 9/1997 | Vought et al. | |
| 6,148,926 | A | 11/2000 | Manor et al. | |
| 6,176,551 | B1 * | 1/2001 | Page | E01C 23/088 172/684.5 |
| 6,368,014 | B1 * | 4/2002 | Culver | E01C 21/00 404/90 |

(Continued)

*Primary Examiner* — David J Bagnell
*Assistant Examiner* — Michael A Goodwin
(74) *Attorney, Agent, or Firm* — Tomlinson McKinstry, P.C.

(57) ABSTRACT

A cutting device adapted to be pulled by a trailer. The cutting device comprises a frame which supports an engine and a cutting drum assembly powered by the engine. The cutting drum assembly comprises a self-aligning mount that allows movement of its drum relative to the frame. The engine is positioned such that its weight is provided to the cutting drum assembly to maintain a consistent depth of the cutting drum. A linear actuator, such as a hydraulic cylinder, allows the frame to pivot internally, so that the cutting drum assembly may be raised and lowered relative to the ground while translating the frame on wheels.

20 Claims, 8 Drawing Sheets

(56) References Cited

U.S. PATENT DOCUMENTS

| | | | | |
|---|---|---|---|---|
| 6,402,252 | B1 * | 6/2002 | Dickson | E01C 23/0993 299/39.6 |
| 6,485,227 | B1 * | 11/2002 | Mathiowetz | E01C 23/127 299/39.4 |
| 6,560,905 | B2 | 5/2003 | Monroe | |
| 6,772,578 | B2 | 8/2004 | Schrattenecker | |
| 6,871,485 | B2 | 3/2005 | Schafer | |
| 7,096,900 | B2 | 8/2006 | Schafer | |
| 2005/0167533 | A1 * | 8/2005 | Christy | E01C 19/201 239/668 |
| 2008/0264658 | A1 * | 10/2008 | Beller | D21G 9/0009 172/518 |
| 2010/0135724 | A1 * | 6/2010 | Roth | E01C 19/235 404/124 |
| 2012/0027514 | A1 * | 2/2012 | Hall | E01C 23/065 404/91 |
| 2012/0121330 | A1 * | 5/2012 | Latham | E01C 23/088 404/86 |
| 2013/0134765 | A1 * | 5/2013 | Haroldsen | B62D 5/20 299/39.6 |

* cited by examiner

ATTACHMENT FOR CLEARANCE OF WORKSITES

CROSS REFERENCE TO RELATED APPLICATION

This application claims the benefit of provisional patent application Ser. No. 61/971,871 filed on Mar. 28, 2014, the entire contents of which are incorporated herein by reference.

FIELD

The present invention relates to balancing assemblies for rotating members for use in removing obstructions from a work site. More particularly, the invention relates to self aligning balancing assemblies for large cylindrical cutting members supported on a trailer.

SUMMARY

The present invention is directed to a device for crushing a hard surface. The device comprises a frame, a linear actuator, a rotatable cutting drum and an engine. The frame comprises a first ground engaging member, a second ground engaging member and a pivot point disposed between the first ground engaging member and the second ground engaging member, wherein a pivot axis of the pivot point is substantially horizontal. The linear actuator is disposed on the frame to change a height of the pivot point. The rotatable cutting drum is disposed on the frame such that a height of the rotatable cutting drum is changed when the height of the pivot point is changed. The engine has a weight and is disposed on the frame above the cutting drum such that the weight of the engine is substantially transferred into the ground by the cutting drum.

DETAILED DESCRIPTION

Figure 1:
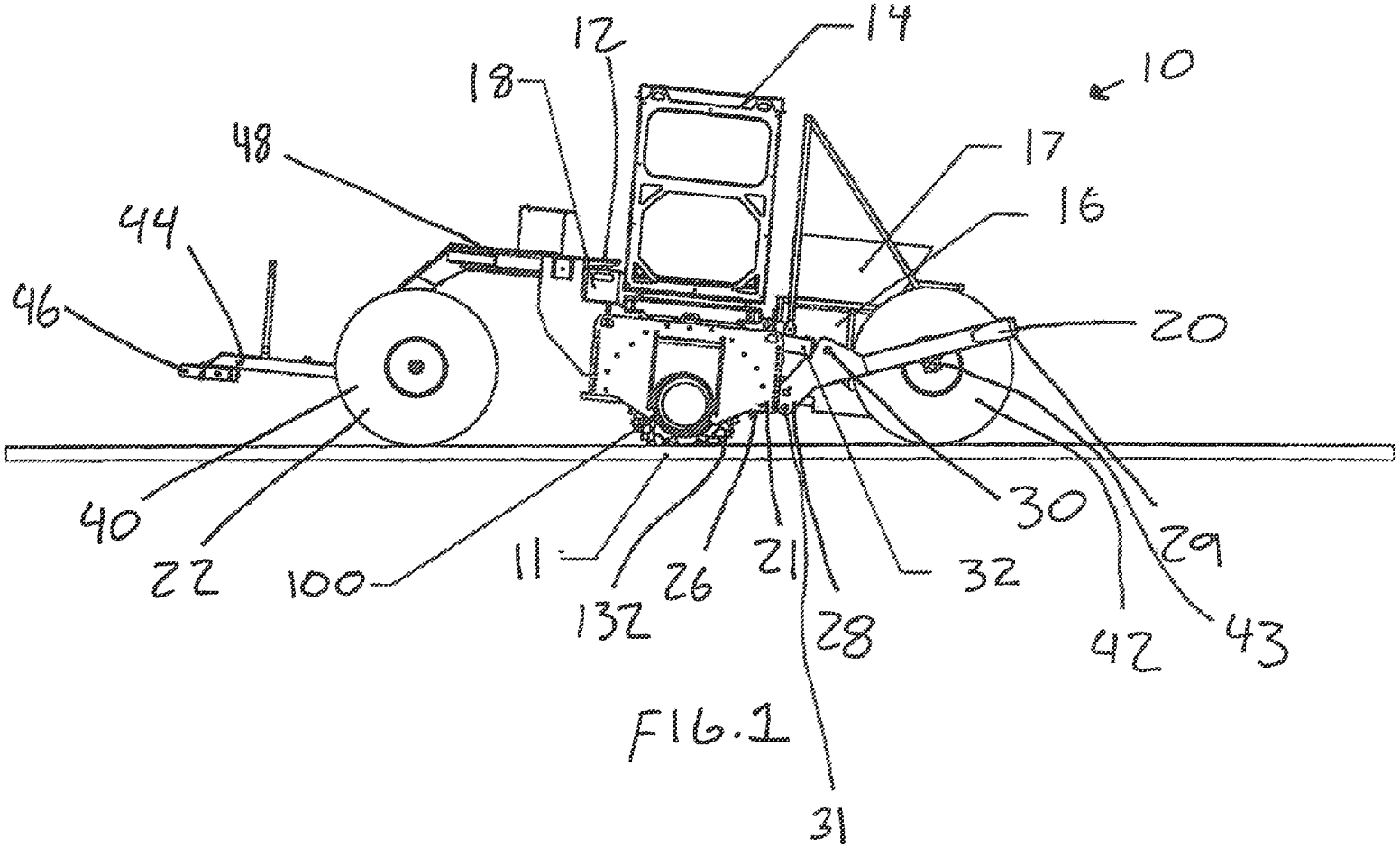
FIG. 1 is a side view of a crushing assembly in accordance with the present invention.

Cylindrical drum assemblies are generally massive and require a high torque motor or engine to initiate rotation of the drum and to maintain rotation during operation. Although the drum assemblies are rotated at a low number of revolutions per minute (rpm), the high mass of the drum results in several problems. First, the centrifugal force produced by the rotation of a high mass structure is extreme even at low rpm and necessitates a robust, heavy duty gear box to transmit the rotational force of the motor to the drum. Often, a separate gear box and motor assembly is used on each of the opposing ends of the axis about which the drum rotates. In such a configuration, one gear box and motor assembly is structured for clockwise rotation and the opposing gear box and motor assembly is structured for counter-clockwise rotation so that their rotational force combines to rotate the drum in a single direction. These gear box and motor assemblies distribute the force required to rotate the drum so that less robust gear boxes and motors may be used.

Second, if the drum is unbalanced around the axis of rotation so as to produce an oscillating radial force, this radial force will excessively wear the gear box and motor so as to cause premature failure. When using a pair of opposing gear box and motor assemblies, the alignment of the centerline of both assemblies reduces radial forces and resultant wear on the bearings of these assemblies; otherwise the misalignment may cause premature failure of the bearings. This alignment may be achieved by precise machining and balancing of the drum. However, such machining and balancing for drums with diameters in excess of 12 inches and lengths in excess of five feet requires large, heavy duty, and expensive machines to turn the massive drums and cut away excess metal. High precision is difficult to attain when dealing with such heavy, bulky structures. Additionally, the removal, shipping, and replacement of the drum in its installed location is expensive in terms of required man power. The removal, shipping, and replacement can also be further complicated by the fact that machines employing such heavy drums, e.g., road equipment, are often used in remote locations where transportation is difficult and knowledgeable maintenance personnel are unavailable.

Third, during use, the drum is loaded by the work against which it rotates, e.g., the road surface for a cutting drum or the uneven winding of paper on a takeup drum in a paper plant. This loading coupled with the massiveness of the drum causes a small amount of deflection which also results in unbalancing of the drum assembly.

Fourth, even if the drum is perfectly balanced about its axis of rotation, the gear box must be positioned precisely so that the shaft is exactly colinear with the axis of rotation. This requires that the mounting surfaces for the gear box must be machined to very precise tolerances. On a large machine, this is very difficult and expensive, and, while it improves the initial misalignment, it does not help with the deflection problem.

As can be seen, there is a need for a method and apparatus to maintain the balance of a massive rotating drum assembly, reduce the requirement for close precision in the physical balancing process for the drum, and dynamically adjust for in-use deflection of the drum so that balance about the axis of rotation is maintained.

Finally, while such drum assemblies have been used in conjunction with dedicated machines, it would be advantageous to utilize such assemblies with a weighted, pull-behind trailer that could be pulled behind a tractor or similar heavy construction vehicle. Thus, while the overall weight of the trailer will be less as compared with the weight of a dedicated machine, placement on a trailer would allow the engine, fuel tank, and other heavy elements to be placed directly above the drum, increasing the stability of the drum and reducing the hydraulic load required.

The device of the figures generally is used for grinding rock and hard earth for the preparation of road beds and for removing obstructions, such as brush and trees, from a worksite. The trailer comprises a frame and a rotatable cutting member, or drum, which is supported on the frame at both ends of the cutting member. A gear box and motor are located at one and/or both ends of the cutting member and are covered by a protective panel attached to an end plate. The surface of the cutting member supports cutting blades or teeth for removing obstructions or undesired materials as the drum rotates.

Figure 2:
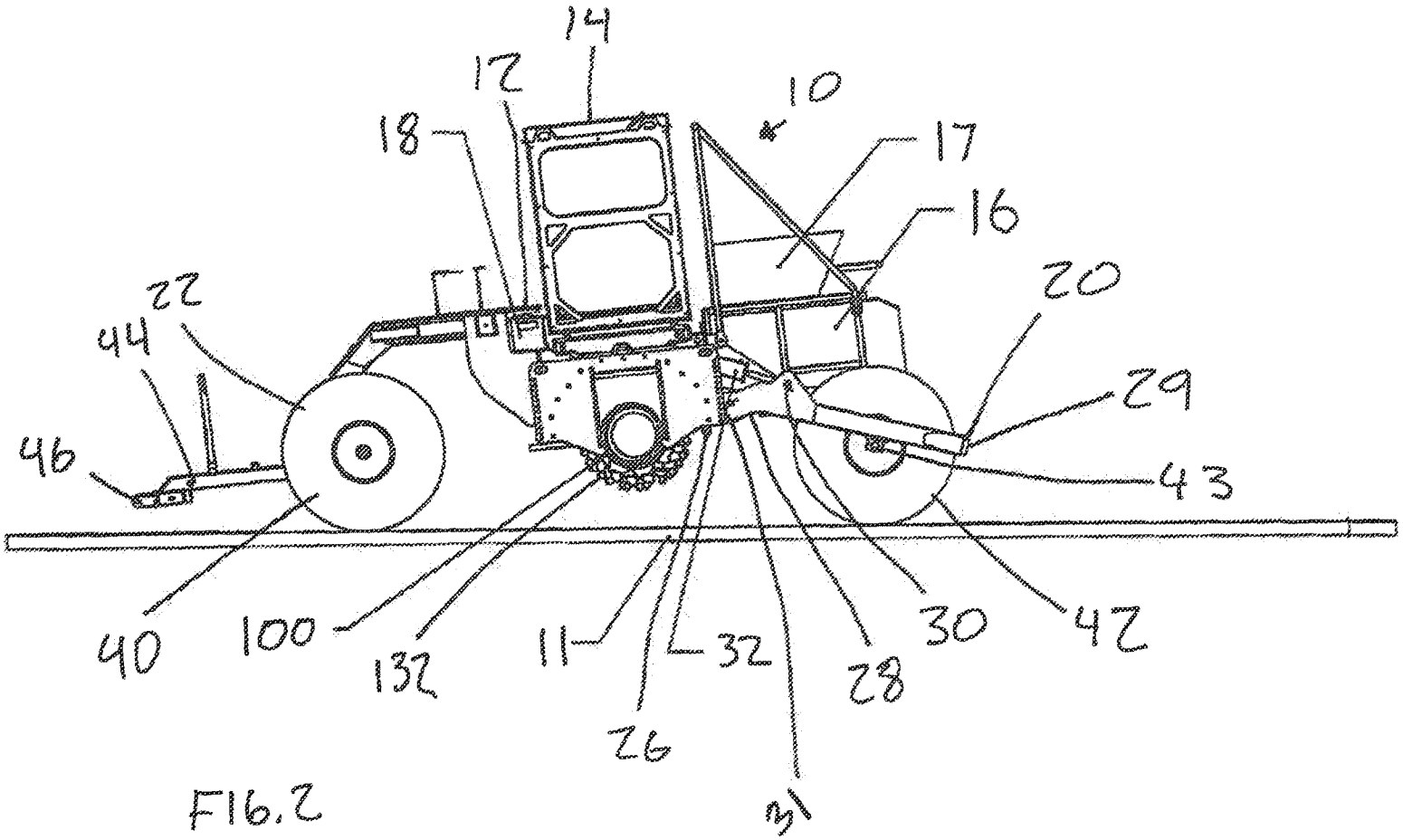
FIG. 2 is a side view of the crushing assembly of FIG. 1 with a pivot frame cylinder extended.
Figure 3:
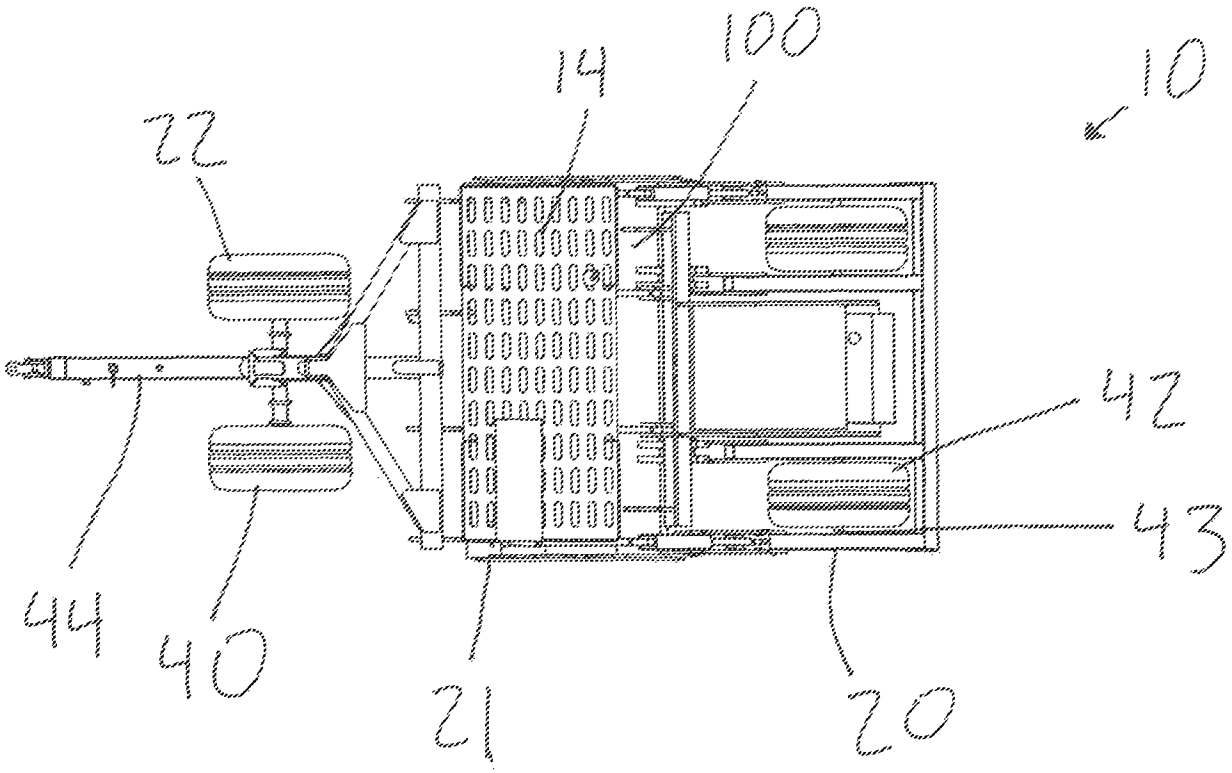
FIG. 3 is a top view of the crushing assembly of FIG. 1.

With reference now to FIGS. 1, 2 and 3, shown therein is a crushing attachment 10 for crushing a surface of the ground 11. The crushing assembly 10 comprises a frame 12, an engine 14, a water tank 16, a fuel tank 17, a battery 18, ground supporting members 22, a dust suppression system 26 and a drum assembly 100. The frame 12 supports various components of the crushing assembly 10, and comprises a pivot frame 20, a central frame 21, and a hitch portion 44. The pivot frame 20 may also be considered the lower frame, and the central frame 21 and hitch portion 44 may together be considered the upper frame. The engine 14 is supported on the central frame 21 portion of the upper frame and provides power to the drum assembly 100 and the pivot frame 20. The engine 14 is disposed on the frame 12 above the cutting drum assembly 100 such that at least a portion of the cuffing drum 100 is directly above a footprint of the engine 14. The term footprint should be understood to mean, the area on the ground surface 11 directly below the engine 14. The water tank 16 is supported on the frame 12 and provides water to the dust-suppression system 26. The dust-suppression system 26 may comprise one or more spray nozzles that moisten small particulate matter and reduce dust caused by operation of the drum assembly 100. The fuel tank 17 provides fuel to the engine 14. Alternatively, the fuel tank 17 may be remote from the frame 12. As shown the engine 14 provides weight to the central frame 21 that is transferred into the ground 11 by the drum assembly 100 when the drum assembly engages the ground. One of skill may appreciate that the fuel tank 17 and water tank 16 may also provide weight to the drum assembly 100.

The battery 18 provides direct electric current to components of the crushing assembly, including the engine 14 for starting purposes. Further, the battery 18 may power actuators located on the crushing assembly 10 which may control the pivot frame 20, the height and rotation rate of the drum assembly 100, sensors (not shown), etc.

The pivot frame 20 defines a first end 28 and a second end 29, The pivot frame 20 is attached to the central portion of the frame 21 at at the first end 28. The pivot frame 20 is further connected to the central portion of the frame 21 via a pivot frame cylinder 32. The pivot frame cylinder 32 is attached at a first end to the central portion of the frame 21 and at a second end to the pivot frame 20, and extendable between a first and second position. The pivot frame cylinder 32 attaches to the pivot frame 20 at a connection point 30. The connection point 30 is disposed on the pivot frame 20 between the first end 28 and the second end 29. The pivot frame 20 pivots about the central frame 21 at pivot point 31. The pivot point 31 has a substantially horizontal pivot axis. As shown in FIG. 1, the pivot frame cylinder 32 is in a retracted position. When the pivot frame cylinder 32 is extended, the pivot point 31 is forced up away from the ground 11, as in FIG. 2, One of skill can appreciate that alternative actuators, such as rack and pinion, screw jacks, or others may be used in place of pivot frame cylinder 32 to cause the pivot point 31 to raise and lower. Raising a height of the pivot point 31 causes the drum assembly 100 to lift off of a surface of the ground 11 for transportation of the crushing assembly 10. Lowering the pivot point 31 causes the drum assembly 100 to be lowered to the surface of the ground 11 for crushing operations, as shown in FIG. 1.

The ground supporting members 22 are located on opposing ends of the crushing assembly 10 and adapted for translation of the crushing assembly and its component parts across the ground 11. As shown, the ground supporting members 22 comprise wheels, though a tracked system may be utilized without departing from the spirit of the invention. As shown, the ground supporting members 22 comprise first or front wheels 40 and second or rear wheels 42. As shown in FIGS. 1-2, the diameter of the wheels 40 and 42 may exceed the diameter of the drum assembly 100. The rear wheels, as shown, are located on the lower or pivot frame 20 and attached to the pivot frame by a pivot frame pin 43. The pivot frame 20 preferably does not extend higher above the ground than any of the rear wheels 42 it supports. The front wheels 40 are located on the hitch portion 44 f the upper frame. Preferably, the drum assembly 100 is located closer to the pivot point 31 than front wheels 40 to reduce hydraulic load required to raise the drum assembly 100 completely off the ground 11. The pivot point 31 may be positioned closer to the ground than the axis of rotation of any of the rear wheels 42. The pivot point 31 is also movable between positions above and below the axis of rotation of the rear wheels 42, as shown in FIGS. 1-2. The hitch portion 44 comprises a hitch 46 and an attachment point 48. The hitch 46 allows the crushing assembly 10 to be attached to a tractor (not shown), truck, or other vehicle for providing motive translational force to the crushing assembly. The attachment point 48 provides attachment between the central frame 21 and hitch portion 44. The attachment point 48 may provide for articulation between the central frame 21 and hitch portion 44 to allow for a reduced turning radius of the crushing assembly 10. One of skill will appreciate that a vertical pivot may alternatively be utilized between the central frame 21 and the hitch portion 44 to allow the same vertical displacement of the cutting drum assembly 100 as pivot frame cylinder 32.

With reference to FIG. 3, the crushing assembly 10 is shown from an overhead view. As shown, the engine 14 extends along the entire width of the central frame 21 and the cutting drum assembly 100. As shown, the ground supporting members 22 comprise two front wheels 40 and two rear wheels 42.

Figure 4:
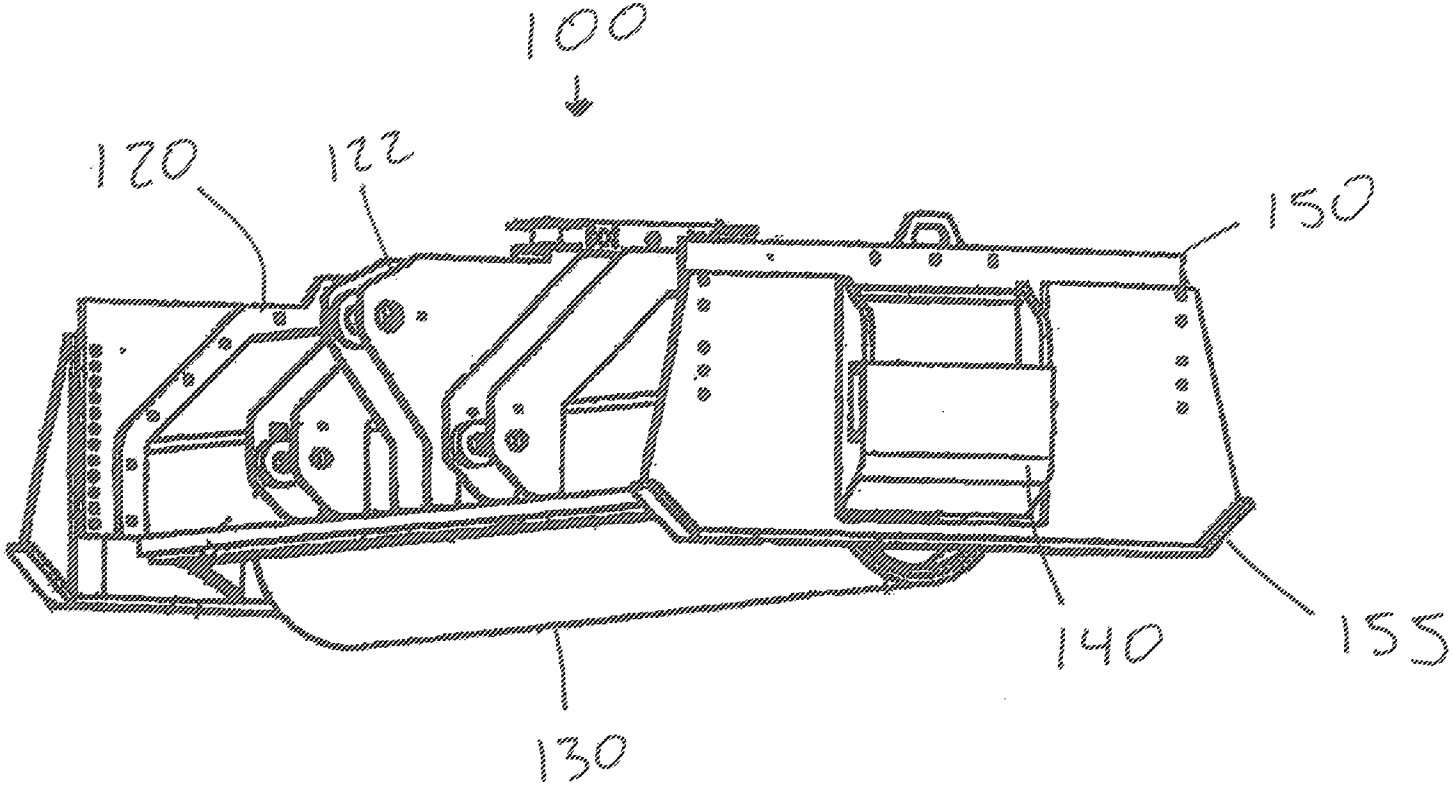
FIG. 4 is a perspective view of the cutting drum assembly for use with the crushing assembly of FIG. 1.
Figure 5:
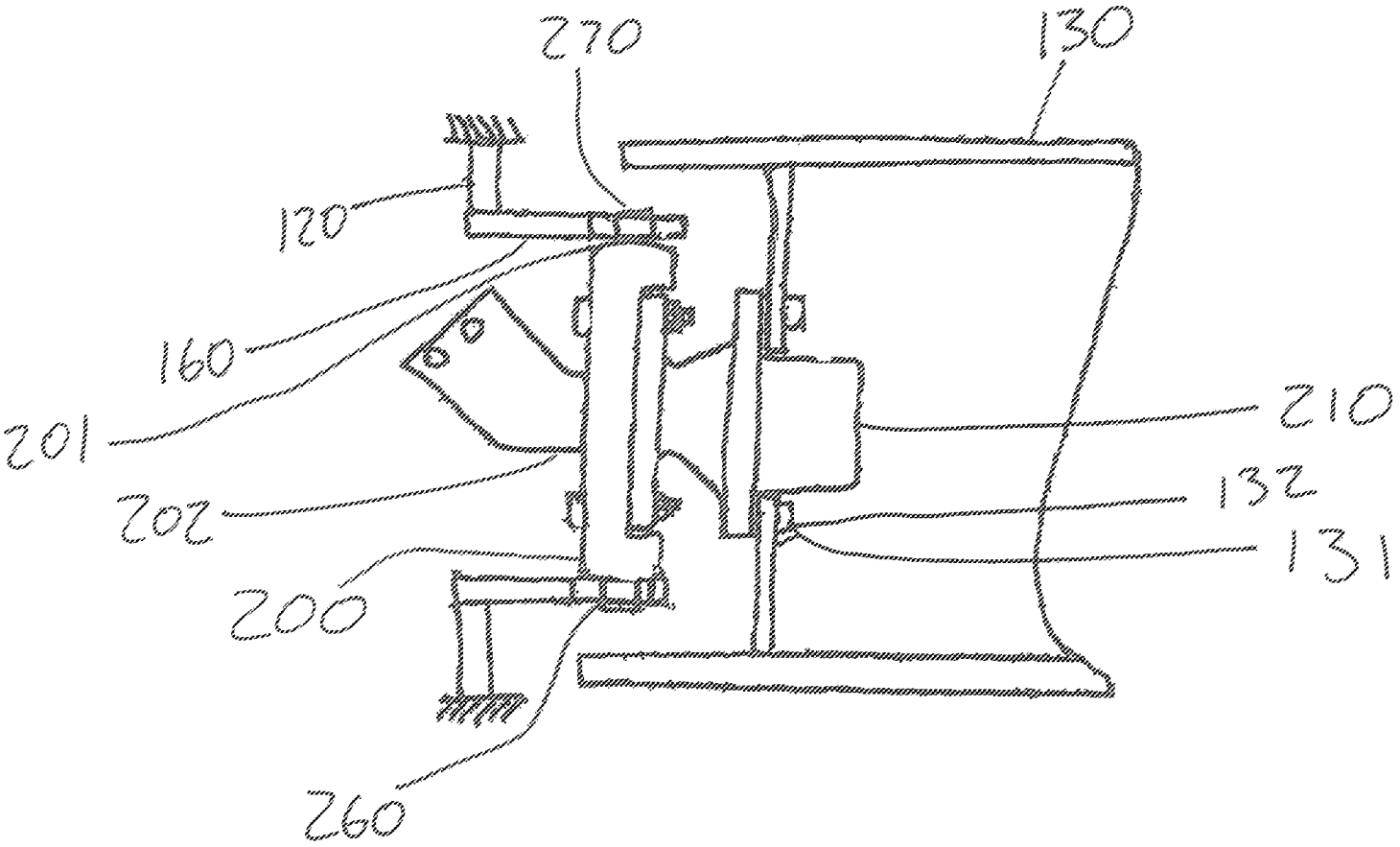
FIG. 5 is a partial cut-away view of components of a self-aligning mount for use with the cutting drum of the present invention.

Referring now to FIG. 4, the cutting drum assembly 100 is shown in more detail. The cutting drum assembly 100 is used for grinding rock and hard earth for the preparation of road beds and for removing obstructions, such as brush and trees, from a worksite. The cutting drum assembly 100 comprises a frame 120 and a rotatable cutting member 130, or drum, which is supported on the frame at both ends of the cutting member. The cutting member 130 is shown herein without teeth, but one of skill in the art will appreciate that such cutting members comprise teeth 132 (FIG. 1) with features, such as carbide inserts, for breaking, crushing and grinding objects as the cutting member rotates. With reference to FIG. 5, a gear box 210 and motor 202 are located at one and/or both ends of the cutting member 130. With reference again to FIG. 4, the gear box 210 and motor 202 are covered by a protective panel 140.

The cutting drum assembly 100 comprises a plurality of skid shoes 155 located on the frame 120. The skid shoes 155 provide a surface of contact between the ground and the cutting drum assembly 100. Preferably, the skid shoes 155 may be adapted such that a distance between a centerline of the cutting member 130 and the ground may be manipulated by an orientation of the skid shoes. More preferably, the orientation of the skid shoes 155 may be manipulated by control on the crushing assembly 10 (FIG. 1) or through other mechanical or hydraulic manipulation. Alternatively, the skid shoes 155 may be moveable relative to the cutting member 130 through the use of a hydraulic cylinder or mechanical means located on the frame 120. Further, a plurality of bolts could be disconnected and the skid shoes 155 repositioned to adjust the distance between the centerline of the cutting member 130 and the ground, which in turn adjusts the depth of the crushing operation performed by the cutting member.

The cutting drum assembly 100 may be adjustable relative to the central frame 21 (FIG. 1) through attachment to a pivotal attachment 122, or may be integral with the frame 12 as shown in FIGS. 1-3, with depth controlled by adjustment of the pivot frame cylinder 32.

With reference again to FIG. 5, a sectional view of the cutting drum assembly 100 is shown. The cutting drum assembly 100 comprises the frame 120, the cutting member 130, a support structure 160, a self-aligning mount 200, the motor 202 and gearbox 210.

The frame 120 provides support for other elements of the cutting drum assembly 100. The support structure 160 is constrained to contain self-aligning mount 200. The mount 200 is non-rotatably supported within the support structure 160 by radially extending retaining members or protrusions 260 adapted to mate with the gaps 270 in the support housing 160. The mount 200 may comprise an edge 201 that is a sectional ellipsoid or sphere. The protrusions 260 are sized within the gaps 270 such that the mount 200 is moveable about three axes relative to the support structure 160, limited only by the tolerance of the gaps 270 relative to the protrusions 260. The protrusions 260 are sufficiently sized such that rotational forces due to operation of the motor 202 and the cutting member 130 are fully transferred to the frame 120, while allowing the mount 200 some tolerance of motion about at least one axis. Preferably, some tolerance of motion is allowed about at least three axes. The edge 201 further allows freedom of movement between the support structure 160 and mount 200.

The motor 202 is connected to the cutting member 130 to rotate the cutting member. Alternatively, the motor may comprise hydraulic or other components adapted to provide a rotational force to the cutting member 130. The motor 202 may be powered by the engine 14 (FIG. 1). The motor 202 provides power which is transferred to rotational motion by the gear box 210. As shown, the self-aligning mount 200 is suspended within the support housing 160 and the gear box 210 is attached to an inner surface of the rotating cutting member 130 at an internal drum 131 by bolts 132. Alternatively, a belt or chain system may be utilized to provide rotational motion to the rotating cutting member 130.

Figure 6A:
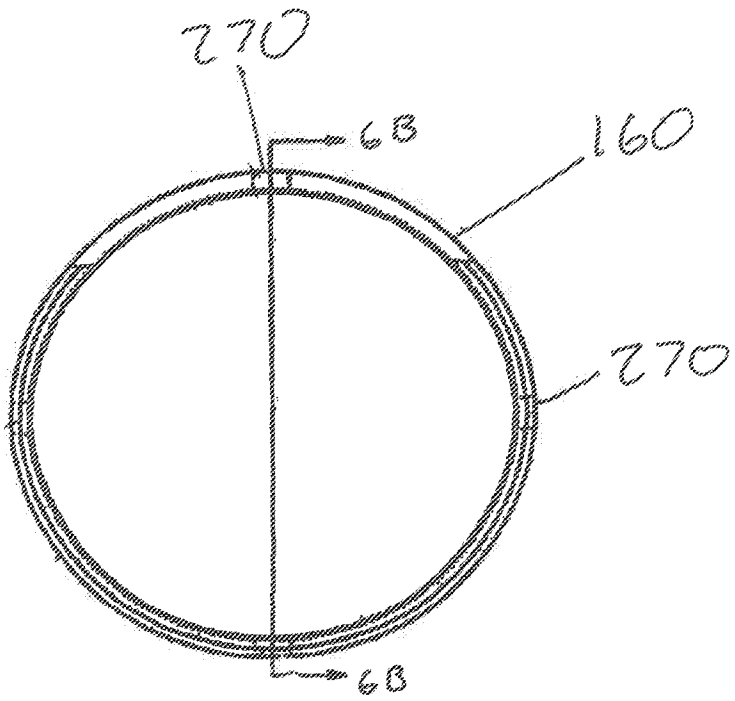
FIG. 6A is a plane view of the support housing of the present invention.
Figure 6B:
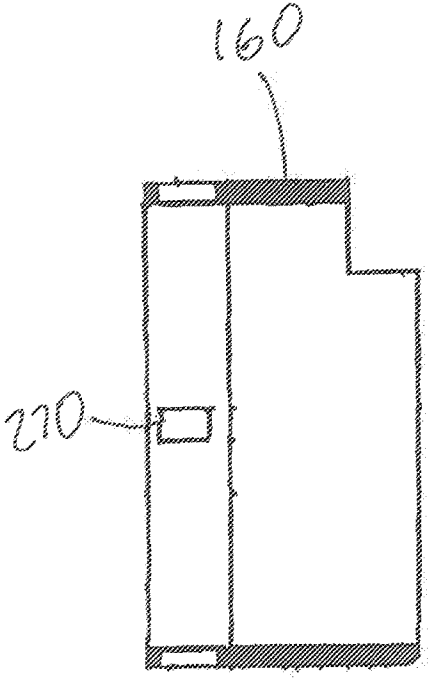
FIG. 6B is a sectional view of the support housing shown in FIG. 6A showing longitudinal slots therein.

Referring now to FIGS. 6A and 6B, shown therein is the support housing 160. As shown, the support housing 160 comprises four (4) of the gaps 270 equally spaced about the support housing. Alternatively, a different number of gaps 270 or spacings thereof may be utilized, as long as those gaps correspond to the features of the mount 200 (FIG. 5).

It should be noted that contact operation of the cutting drum assembly 100 may cause the teeth to become deflected or broken. Deflected or broken teeth 132 (FIG. 1) may cause slight deviations in the weight of the cutting member 130. Even slight deviations in the weight of the cutting member 30 may cause it to become slightly unbalanced. Additionally, extreme cold weather may cause internal components of the cutting member 130 to expand due to heat caused by rotation of the cutting member, while the frame may contract due to external temperatures. The self-aligning mount 200 is introduced to solve these and other problems.

Figure 7:
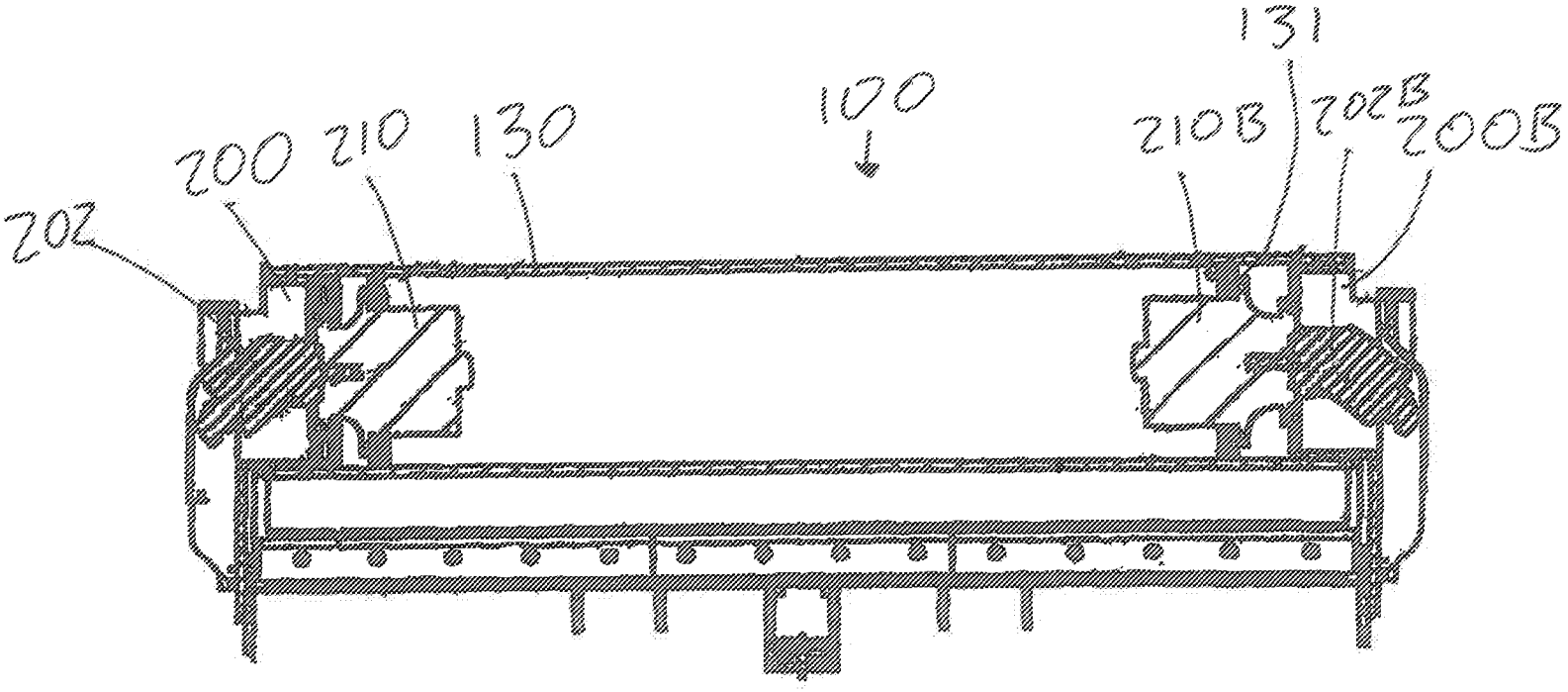
FIG. 7 is a sectional view of a cutting drum assembly for use with the present invention.

Turning now to FIG. 7, a cross-section of the cutting drum assembly 100 is shown. As shown, the cutting drum assembly 100 further comprises a second mount 200B, a second motor 202B comprising a second gear box 210B at a second end of the cutting member 130. The mount 200 and second mount 200B may be substantially identical at each end of the cutting member 130 (FIG. 4). At each end of the cutting member 130 the gear box 210 and second gear box 210A are fixedly bolted to an internal drum 131 within each end of cutting member 130 so that a centerline of each gear box 210, 210A is substantially aligned with the centerline of the rotating cutting member.

One skilled in the art will appreciate the cutting drum assembly 100 may comprise only one motor 202 at one end of the cutting member 130. In this embodiment, the second mount 200B located at the second end of the cutting member 130 would comprise a bearing such that the second end of the cutting member would rotate freely relative to the second mount, while allowing the second mount to move about a plurality of axes relative to the support housing 160 as discussed above with reference to FIG. 5.

The first motor 202 is adapted to operate with sufficient horsepower to rotate the cutting member 130 at an operational rate. For example, the motor may provide an operational rate of thirty-five horsepower in an application utilizing light equipment. Alternatively, heavy-duty applications of the present invention may require an operational rate of five hundred forty horsepower or more. The preferred rotational velocity of the cutting member 130 provided by the motor 202 for crushing surface rock is slow, perhaps 10 to 100 rpm. However, other speeds may be advantageous for other applications of the cutting drum assembly 100, and thus other speeds of the cutting member 130 are anticipated.

Figure 8B:
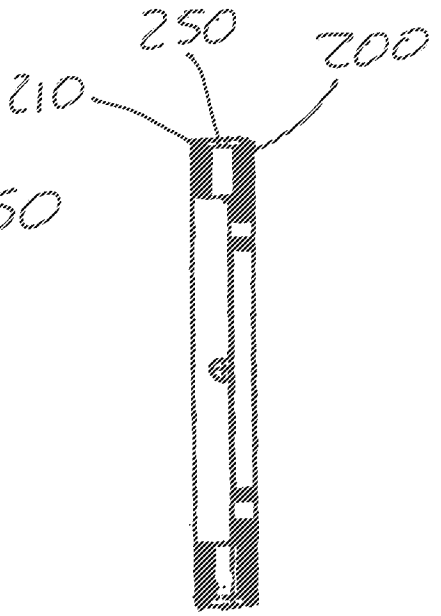
FIG. 8B is a sectional view of the self-aligning flange of FIG. 8A.
Figure 8A:
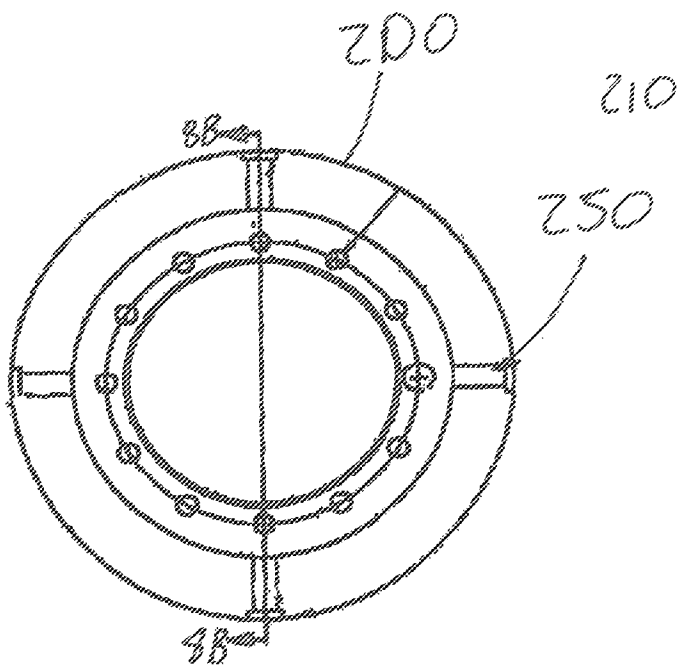
FIG. 8A is a side view of the self-aligning mount.

With reference to FIGS. 8A and 8B, shown therein is a cross section of the mount 200. As shown, the mount 200 comprises a number of axial bolt holes 250. Each of the projections 260 (FIG. 5) are inserted into the holes 250 such that they extend beyond the rim 210 of the mount 200 and engage the support housing 160 at gaps 270 (FIG. 5). Alternatively, projections from the support housing 160 may extend into the bolt holes 250. \

One of ordinary skill in the art will appreciate that modifications may be made to the invention without departing from the spirit herein. For example, a weight can be provided above the cutting drum assembly 100 and the motor 202 powered by an engine on the tractor pulling the crushing assembly 10.

What is claimed is:

1. A device for crushing a hard surface comprising:

a frame comprising a first ground engaging member, a second ground engaging member and a pivot point disposed between the first ground engaging member and the second ground engaging member, wherein a pivot axis of the pivot point is horizontal;

a linear actuator disposed on the frame to change a height of the pivot point;

a rotatable cutting drum disposed on the frame such that a height of the rotatable cutting drum is changed when the height of the pivot point is changed; and an engine having a weight, wherein the engine is disposed on the frame above the cutting drum such that at least a portion of the cutting drum is directly above a footprint of the engine and the weight of the engine is transferred into the ground by the cutting drum.

2. The device of claim 1 further comprising:

a mount supported on the frame and movable relative to the frame about three axes; and a motor supported by the mount;

wherein the rotatable cutting drum is operatively connected to the motor.

3. The device of claim 2 further comprising:

a second mount supported on the frame and movable relative to the frame about three axes; and a second motor supported by the second mount;

wherein the rotatable cutting drum is operatively connected to the second motor.

4. The device of claim 1 wherein the linear actuator comprises a hydraulic cylinder.

5. The device of claim 4 wherein extending the hydraulic cylinder raises the pivot point.

6. The device of claim 1 wherein the linear actuator comprises a plurality of hydraulic cylinders.

7. The device of claim 1 wherein the first ground engaging member comprises two front wheels located at a first end of the frame and wherein the second ground engaging member comprises two back wheels located at a second end of the frame.

8. The device of claim 1 further comprising a hitch.

9. The device of claim 1 further comprising at least one skid shoe located proximate the rotatable cutting drum to maintain a maximum distance between a centerline of the rotatable cutting drum and a surface of the ground.

10. The device of claim 9 wherein the at least one skid shoe is adjustable.

11. The device of claim 1 further comprising a motor operatively connected to the rotatable cutting drum.

12. A device for crushing a surface comprising:

a frame comprising:

a first section comprising a first ground engaging member;

a second section comprising a second ground engaging member; and a pivot point disposed between the first section and the second section, wherein a pivot axis of the pivot point is horizontal;

a linear actuator disposed between the first section and the second section of the frame, wherein adjusting a length of the linear actuator adjusts a height of the pivot point relative to the surface;

a rotatable cutting drum disposed on the first section of the frame such that a height of the rotatable cutting drum relative to the surface is adjusted in an identical direction as the pivot point by the linear actuator; and an engine supported by the first section of the frame above the rotatable cutting drum such that at least a portion of the rotatable cutting drum is directly above a footprint of the engine.

13. The device of claim 12 wherein the rotatable cutting drum is closer to the pivot point than it is to the first ground engaging member.

14. The device of claim 12 wherein the engine provides power for rotation of the rotatable cutting drum.

15. The device of claim 14 wherein the engine defines a weight, wherein the engine is disposed on the frame above the cutting drum such that at least one half of the weight of the engine is transferred into the ground by the cutting drum.

16. The device of claim 15 wherein the frame comprises slots such that the rotatable cutting drum is allowed movement relative to the frame within the slots about three axes.

17. The device of claim 12 further comprising a motor operatively connected to the rotatable cutting drum.

18. An apparatus comprising:

a trailer comprising:

a first section and a second section, wherein the first section is pivotally connected to the second section about a pivot point; and a rotatable cutting drum supported on the first section and operatively connected to a motor such that the motor rotates the rotatable cutting drum;

a hydraulic cylinder disposed between the first section of the trailer and the second section of the trailer wherein the hydraulic cylinder is extendable along its length, such that the rotatable cutting drum and the pivot point are moved vertically by extension of the cylinder; and an engine supported by the first section of the trailer above the rotatable cutting drum such that at least a portion of the rotatable cutting drum is directly above a footprint of the engine.

19. The apparatus of claim 18 wherein the engine is disposed above the rotatable cutting drum such that a weight of the engine is transferred into the ground by the cutting drum.

20. The apparatus of claim 18 wherein the rotatable cutting drum is movable about three axes relative to the first section.

* * * * *